US009877614B1

(12) United States Patent
Albert

(10) Patent No.: US 9,877,614 B1
(45) Date of Patent: Jan. 30, 2018

(54) SINK-BASED TOILETRY ORGANIZER WITH INTEGRATED DRAIN

(71) Applicant: Alfred Albert, Kailua Kona, HI (US)

(72) Inventor: Alfred Albert, Kailua Kona, HI (US)

( * ) Notice: Subject to any disclaimer, the term of this patent is extended or adjusted under 35 U.S.C. 154(b) by 0 days.

(21) Appl. No.: 15/391,045

(22) Filed: Dec. 27, 2016

(51) Int. Cl.

| | |
|---|---|
| ***B65D 69/00*** | (2006.01) |
| ***A47K 1/09*** | (2006.01) |
| ***B65D 25/04*** | (2006.01) |
| ***B65D 25/20*** | (2006.01) |
| ***A45D 27/22*** | (2006.01) |

(52) U.S. Cl.
CPC ..... *A47K 1/09* (2013.01); *A45D 27/22* (2013.01); *B65D 25/04* (2013.01); *B65D 25/20* (2013.01)

(58) Field of Classification Search
CPC ..... A47K 1/09; A45D 27/22; B65D 25/04; B65D 25/20
USPC ..... 206/581, 561, 557, 361, 362, 362.1, 206/362.2, 363, 368, 369, 823, 372, 373, 206/277; 211/85.12, 65, 66, 85.25, 88.02
See application file for complete search history.

(56) References Cited

U.S. PATENT DOCUMENTS

| | | | | |
|---|---|---|---|---|
| 2,564,353 | A | 8/1951 | Coleman | |
| 3,409,144 | A | 11/1968 | Bridgman | |
| 4,219,035 | A | 8/1980 | Deconinck | |
| 5,033,617 | A * | 7/1991 | Hartwein | A47K 1/09 206/209.1 |
| 5,184,749 | A * | 2/1993 | Attenasio | A47L 13/51 15/257.01 |
| 5,215,193 | A * | 6/1993 | Dennis | A47K 5/18 132/309 |
| 5,485,927 | A * | 1/1996 | Hubbard | A47J 47/20 211/41.3 |
| 6,003,964 | A | 12/1999 | Baker | |
| D458,492 | S | 6/2002 | Ho | |
| 7,299,922 | B2 | 11/2007 | Ceballos | |
| 2004/0050733 | A1 | 3/2004 | Page | |
| 2010/0288659 | A1* | 11/2010 | Dang | A47K 1/09 206/277 |
| 2011/0100865 | A1* | 5/2011 | Brink | A61C 19/02 206/581 |

* cited by examiner

*Primary Examiner* — Jacob K Ackun
*Assistant Examiner* — Jenine Pagan

(57) ABSTRACT

The sink based toiletry organizer with integrated drain is an organizer adapted for use with toiletries. The sink based toiletry organizer with integrated drain stores in an organized manner commonly used bathroom accessories including, but not limited to, soap, toothpaste, a plurality of toothbrushes and one or more razors. The sink based toiletry organizer with integrated drain further comprises a drainage system to drain water that accumulates within the sink based toiletry organizer with integrated drain directly into the sink. The sink based toiletry organizer with integrated drain is a multi-section structure wherein each section of the multi-section structure is intended to contain a specific type of sanitary equipment or toilet accessory. The sink based toiletry organizer with integrated drain comprises a multi-section structure.

9 Claims, 6 Drawing Sheets

SINK-BASED TOILETRY ORGANIZER WITH INTEGRATED DRAIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles, more specifically, a rack adapted for use with sanitary equipment and toilet accessories.

SUMMARY OF INVENTION

The sink based toiletry organizer with integrated drain is an organizer adapted for use with toiletries. The sink based toiletry organizer with integrated drain stores in an organized manner commonly used bathroom accessories including, but not limited to, soap, toothpaste, a plurality of toothbrushes and one or more razors. The sink based toiletry organizer with integrated drain further comprises a drainage system to drain water that accumulates within the sink based toiletry organizer with integrated drain directly into the sink. The sink based toiletry organizer with integrated drain is a multi-section structure wherein each section of the multi-section structure is intended to contain a specific type of sanitary equipment or toilet accessory.

These together with additional objects, features and advantages of the sink based toiletry organizer with integrated drain will be readily apparent to those of ordinary skill in the art upon reading the following detailed description of the presently preferred, but nonetheless illustrative, embodiments when taken in conjunction with the accompanying drawings.

In this respect, before explaining the current embodiments of the sink based toiletry organizer with integrated drain in detail, it is to be understood that the sink based toiletry organizer with integrated drain is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sink based toiletry organizer with integrated drain.

It is therefore important that the claims be regarded as including such equivalent construction insofar as they do not depart from the spirit and scope of the sink based toiletry organizer with integrated drain. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
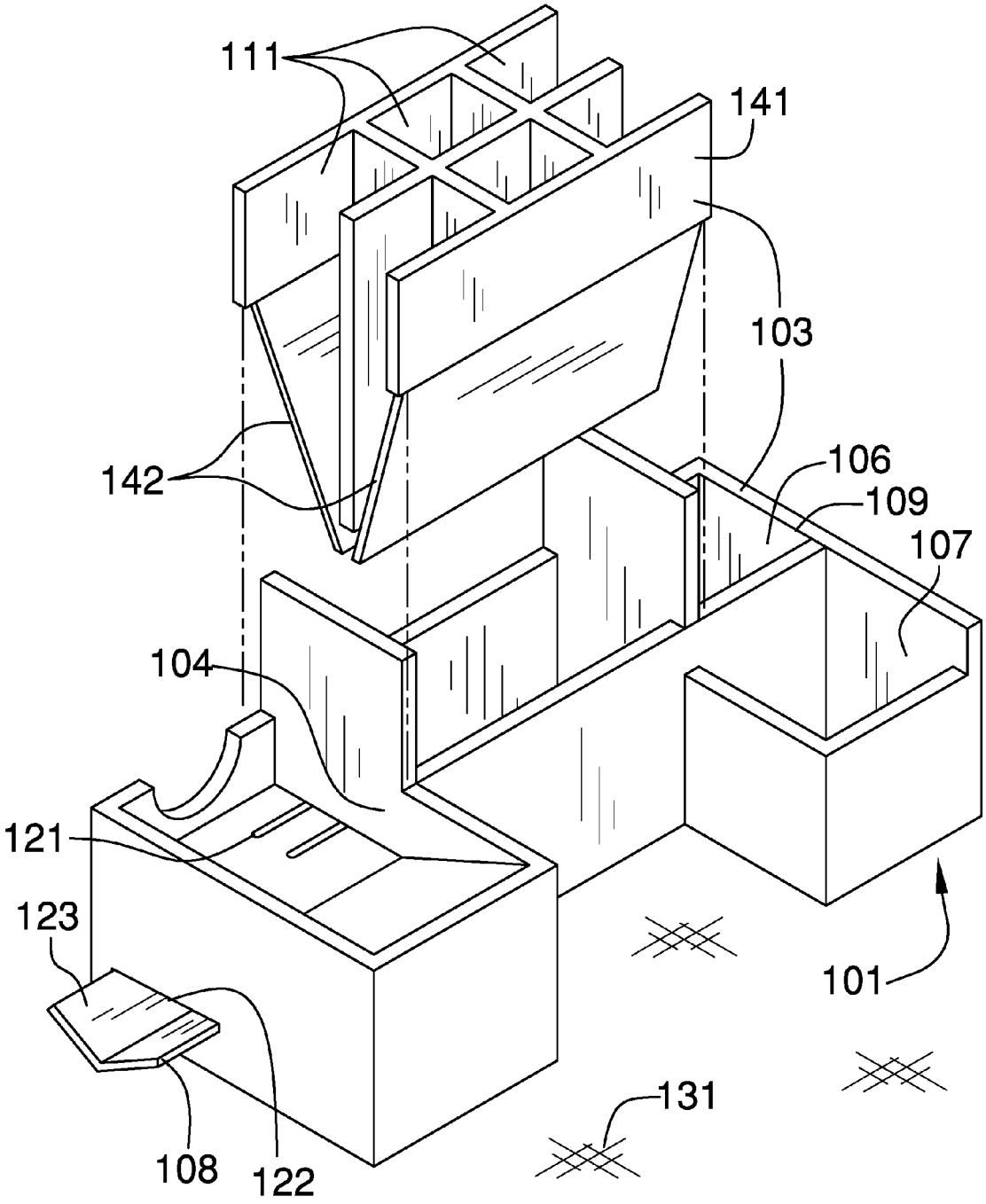
FIG. 1 is a perspective view of an embodiment of the disclosure.
Figure 2:
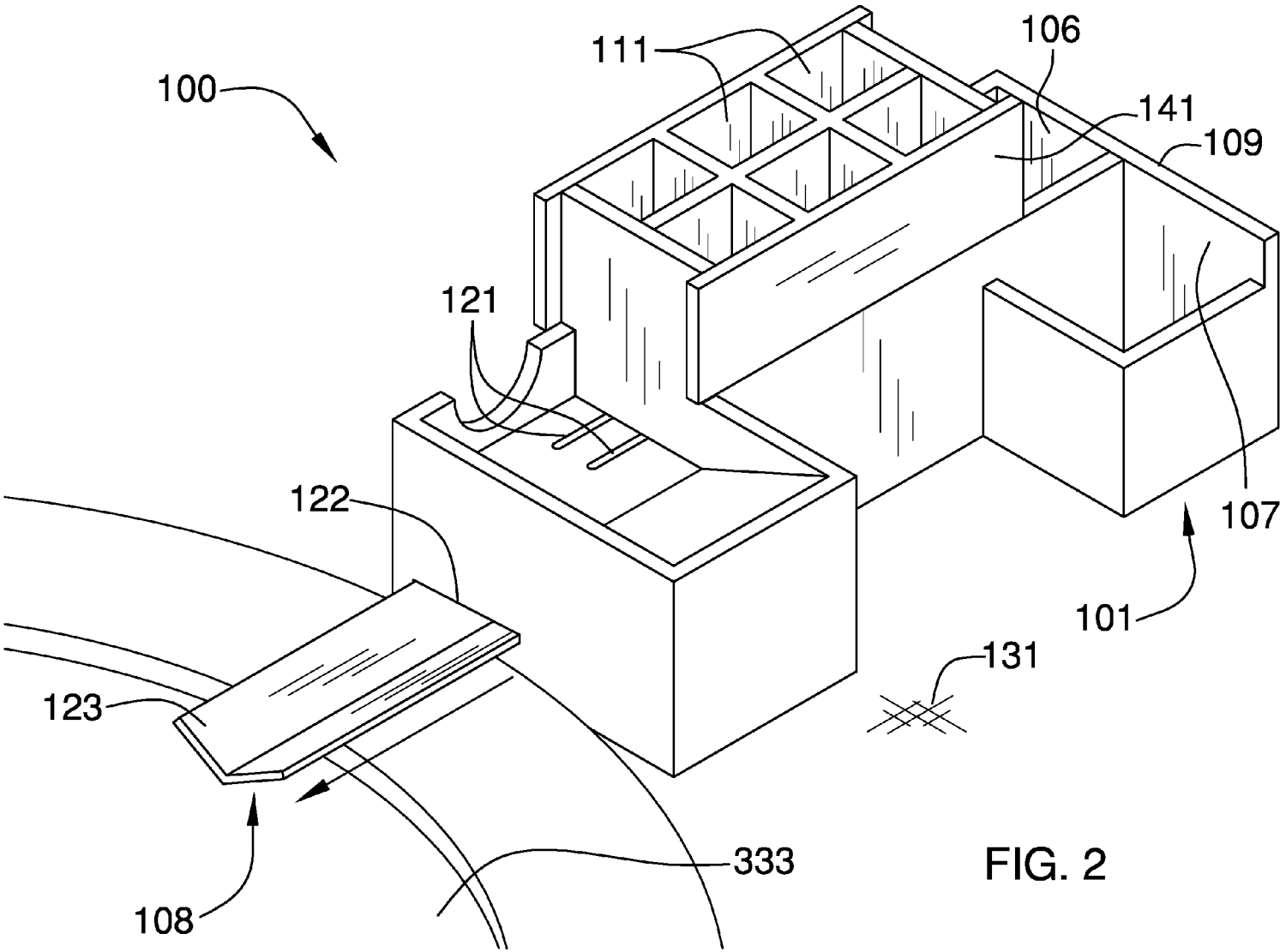
FIG. 2 is another perspective view of an embodiment of the disclosure in use.
Figure 3:
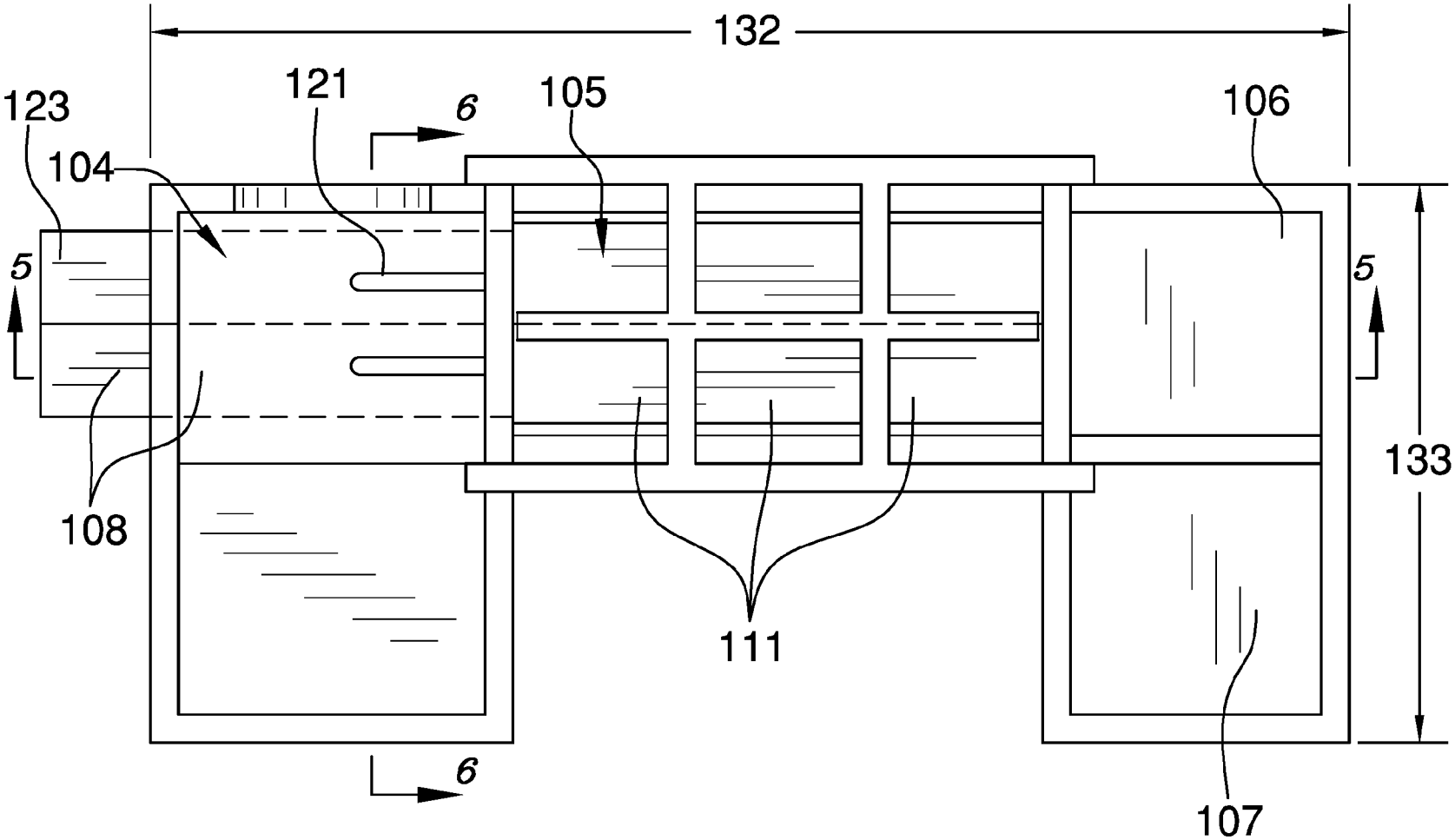
FIG. 3 is a top view of an embodiment of the disclosure.
Figure 4:
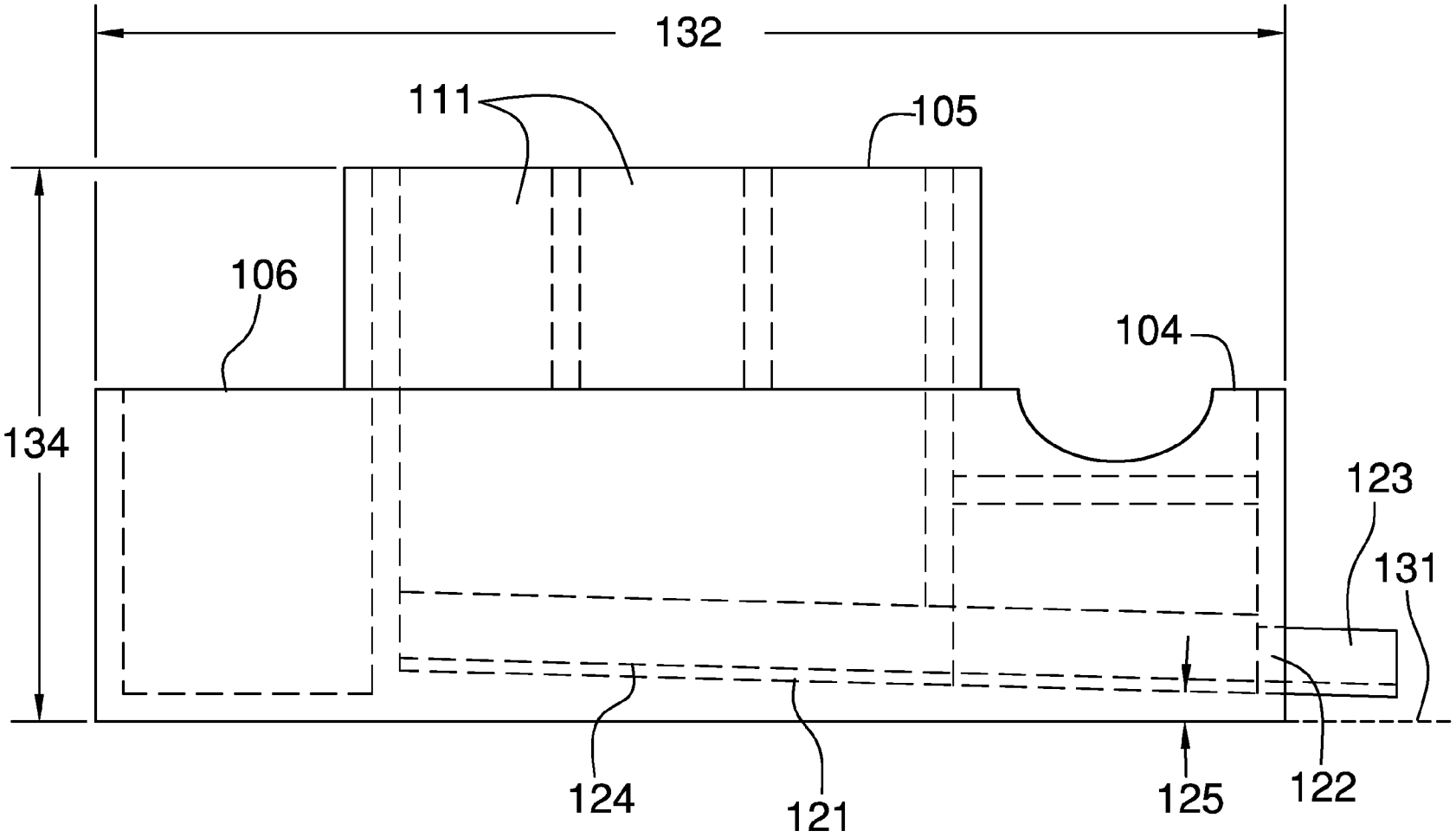
FIG. 4 is a back view of an embodiment of the disclosure.
Figure 5:
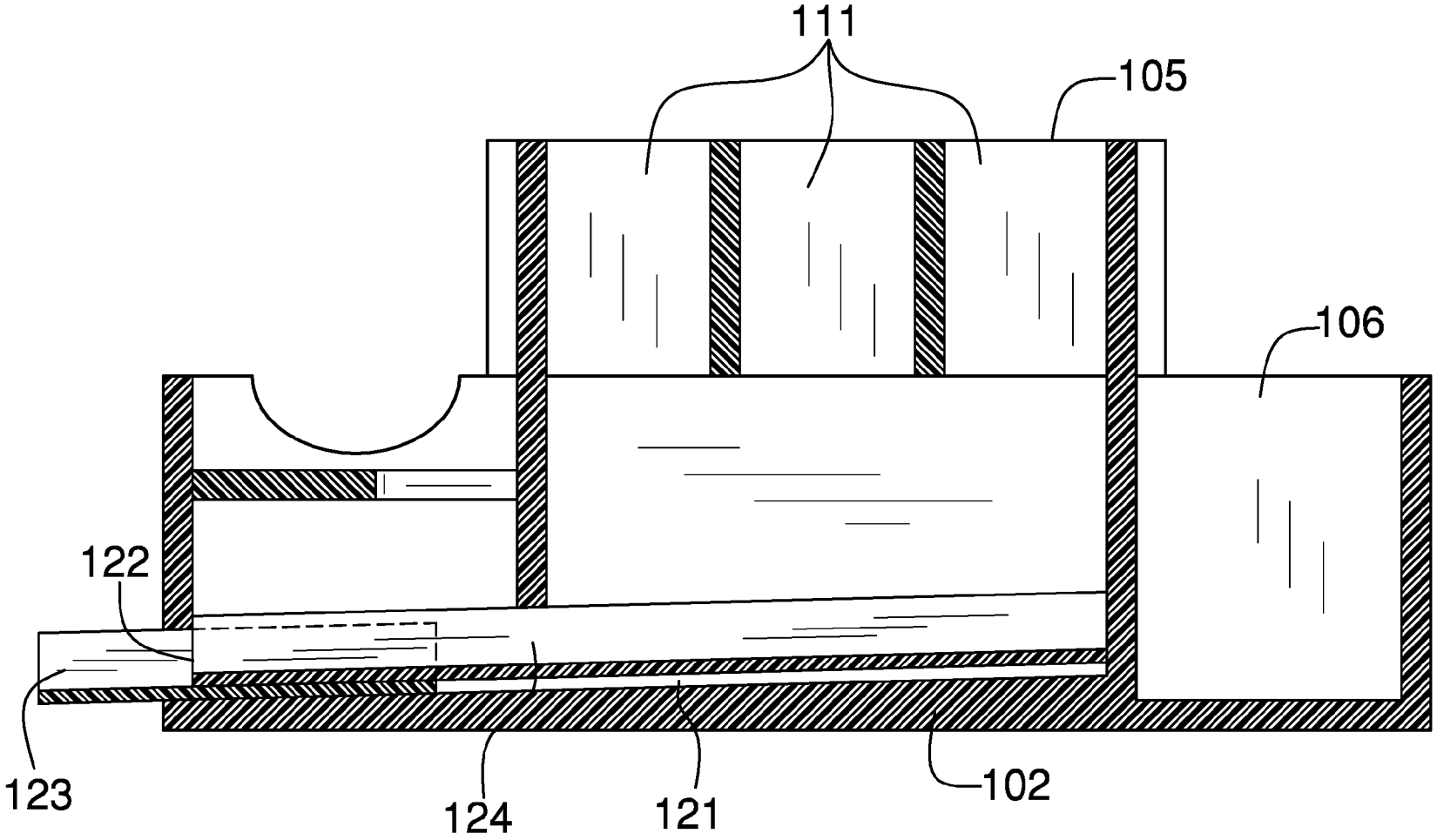
FIG. 5 is a cross-sectional view of an embodiment of the disclosure across 5-5 on FIG. 3.
Figure 6:
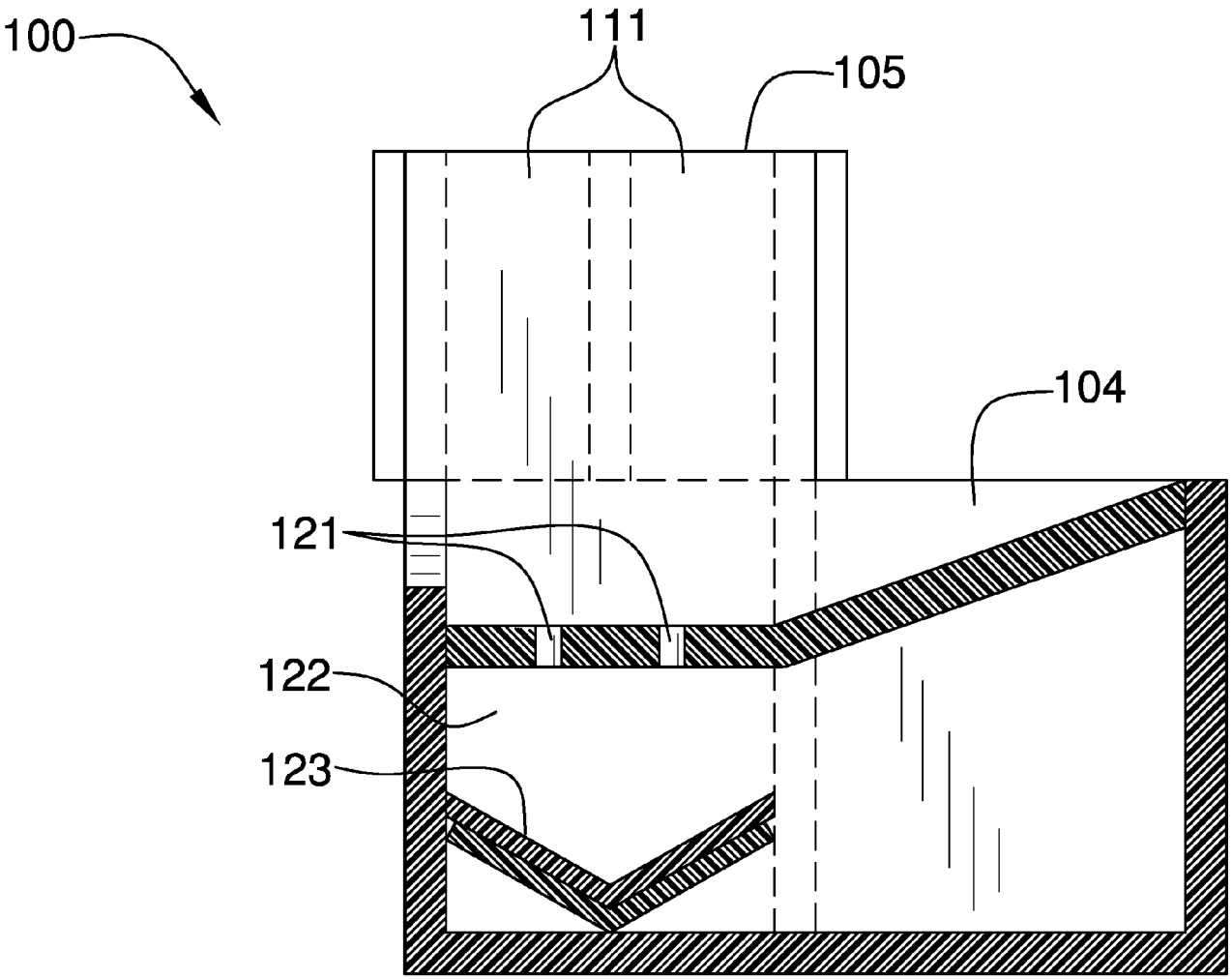
FIG. 6 is a cross-sectional view of an embodiment of the disclosure across 6-6 on FIG. 3.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The sink based toiletry organizer with integrated drain 100 (hereinafter invention) comprises a multi-section structure 101. The invention 100 is an organizer adapted for use with toiletries. The invention 100 stores in an organized manner commonly used bathroom accessories including, but not limited to, soap, toothpaste, a plurality of toothbrushes and one or more razors. The invention 100 further comprises an integrated drain 108 that drains water that accumulates within the invention 100 directly into the sink. The invention 100 is a multi-section structure 101 wherein each compartment of the multi-section structure 101 is intended to contain a specific type of sanitary equipment or toilet accessory.

The multi-section structure 101 is formed as an integrated unit mounted on a common base 102. The base 102 is the foundation upon which the balance of the multi-section structure 101 is formed. The base 102 is the portion of the multi-section structure 101 that rests on a supporting surface 131 while the invention 100 is in use. The supporting surfaced 131 may be on or adjacent to a sink 333, and may be in a bathroom. It shall be noted that the invention 100 is adapted to support toiletries in a bathroom environment. The base 102 is formed with an incline 124. The incline 124 is discussed in detail elsewhere in this disclosure. Each section of the multi-section structure 101 is selected from a plurality of compartments 103. Each individual compartment 109 selected from the plurality of compartments 103 is further defined with a span in the length direction 132, a span in the width direction 133, and a span in the height direction 134. The length direction 132, the width direction 133, and the height direction 134 are each perpendicular to each other.

In the first potential embodiment of the disclosure, each individual compartment 109 selected from the plurality of compartments 103 is formed in the shape of a hollow rectangular block. The faces of each individual compartment 109 are aligned in either a parallel or perpendicular orientation to each of the length direction 132, the width direction 133, and the height direction 134. The base 102 forms a face of each individual compartment 109. The face of each individual compartment 109 that is distal from the base 102 is open such that items can be placed into and removed from each individual compartment 109 through this open face.

For each individual compartment 109 selected from the plurality of compartments 103, the span of the selected individual compartment 109 in the length direction 132 is independent from any other measured span in the length direction 132 of any individual compartment 109 remaining in the plurality of compartments 103. For each individual compartment 109 selected from the plurality of compartments 103, the span of the selected individual compartment 109 in the width direction 133 is independent from any other measured span in the width direction 133 of any individual compartment 109 remaining in the plurality of compartments 103. For each individual compartment 109 selected from the plurality of compartments 103, the span of the selected individual compartment 109 in the height direction 134 is independent from any other measured span in the height direction 134 of any individual compartment 109 remaining in the plurality of compartments 103. To summarize this paragraph less specifically but more clearly: the length 132, width 133, or height 134 of any individual compartment 109 selected from the plurality of compartments 103 need not be related to the length 132, width 133, or height 134 of any individual compartment 109 that remains in the plurality of compartments 103.

The integrated drain 108 drains water that collects within the invention 100 to a collection site such as a sink. The integrated drain 108 comprises a plurality of drain slots 121, a drain port 122, and a drain channel 123. The plurality of drain slots 121 is formed in the incline 124 of the base 102. The incline 124 is a modification in portions of the base 102 underneath selected individual compartments 109. In the portions of the base 102 with the incline 124, the specific modification is a gradient 125 that is formed in the base 102 that causes the surface of the base 102 to deviate from a horizontal orientation such that liquids that accumulate on these portions of the base 102 will flow in a controlled direction.

Each of the plurality of drain slots 121 is a channel formed in the incline 124 portion of the base 102. Where necessary or convenient, each of the plurality of drain slots 121 is routed through the face of any individual compartment 109 selected from the plurality of compartments 103 that would otherwise impede the flow of liquid through any drain slot selected form the plurality of drain slots 121. Each of the plurality of drain slots 121 are formed within the base 102 such that each of the plurality of drain slots 121 will route accumulated water to the drain port 122. The drain port 122 is an aperture formed through the invention 100 that allows accumulated liquids to flow from the plurality of drain slots 121 through the drain port 122 thus evacuating the interior of the invention 100. The drain channel 123 is a gutter that is formed on the exterior side of the drain port 122 such that water that is evacuated from the invention 100 can be routed to a sink or other collection point for disposal.

In the first potential embodiment of the disclosure, the plurality of compartments 103 further comprises a soap compartment 104, a toothbrush compartment 105, a toothpaste compartment 106 and a razor compartment 107.

The soap compartment 104 is an individual compartment 109 that is designed to hold soap. The soap compartment 104 is positioned on an incline 124 portion of the base 102 such that water transported to the invention 100 by the soap can be evacuated from the invention 100. As most clearly shown in FIG. 1, the drain port 122 and the drain channel 123 are formed in the side of the soap compartment 104.

The toothbrush compartment 105 comprises a plurality of individual compartments 109 that are designed to hold one or more toothbrushes. As shown in FIG. 1, the toothbrush compartment 105 is formed as a single removable unit 141 that can be readily removed from the base 102 for cleaning purposes. The removable unit 141 is positioned over an incline 124 portion of the base 102 such that water transported to the invention 100 by one or more toothbrushes can be evacuated from the invention 100. As most clearly shown in FIGS. 1, 2, and 3 the toothbrush compartment 105 further comprises a plurality of toothbrush chambers 111. Each of the plurality of toothbrush chambers 111 is a tube like chamber that is sized to receive the handle of a toothbrush. Each of the plurality of toothbrush chambers 111 is positioned on an incline 124 portion of the base 102. In the first potential embodiment of the disclosure, the plurality of toothbrush chambers 111 comprises six chambers.

A plurality of dividing surfaces are used to form the plurality of individual compartments 109 of the toothbrush compartment 105 within the removable unit 141. As shown most clearly in FIG. 1, the dividers that form the boundary of the width 133 direction of the of the removable unit are tapered 143 towards the incline 124 such that water released by a toothbrush stored within the toothbrush compartment 105 will drain towards the incline 124 and thereafter be evacuated from the invention 100.

The toothpaste compartment 106 is an individual compartment 109 that is designed to hold a single tube of toothpaste.

The razor compartment 107 is an individual compartment 109 that is designed to hold one or more shaving razors.

To use the invention 100, the base 102 of the invention 100 is placed on a bathroom counter such that the drain channel 123 overhangs a sink. Soap is stored in the soap compartment 104, toothbrushes are stored in the toothbrush compartment 105, toothpaste is stored in the toothpaste compartment 106, and razors are stored in the razor compartment 107.

In the first potential embodiment of the disclosure, the invention 100 is formed as a single unit from molded plastic. Suitable plastics include, but are not limited to, polyethylene, polycarbonate, or poly (methyl methacrylic). In the first potential embodiment of the disclosure, polycarbonate is preferred.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic article comprising:

a multi-section structure;

wherein the domestic article is an apparatus adapted for use in organization;

wherein the domestic article is adapted for use with bathroom accessories and toiletries;

wherein the domestic article is adapted to store bathroom accessories and toiletries;

wherein the domestic article is adapted to be positioned on a support surface in order to adaptively store said bathroom accessories and toiletries thereon, and for use within a bathroom environment;

wherein the domestic article further comprises an integrated drain;

wherein the multi-section structure further comprises a base;

wherein the multi-section structure is formed as an integrated unit;

wherein the base is formed with one or more incline portions;

wherein the multi-section structure further comprises a plurality of compartments;

wherein each individual compartment selected from the plurality of compartments is further defined with a length direction, a width direction, and a height direction;

wherein the length direction, the width direction, and the height direction are perpendicular to each other;

wherein each of the faces of each individual compartment are aligned with an orientation selected from the group consisting of parallel or perpendicular;

wherein the orientation of each of the faces of each individual compartment are aligned relative to a direction selected from the group of directions consisting of the length direction, the width direction, or the height direction;

wherein the base forms a face of each individual compartment;

wherein the face of each individual compartment that is distal from the base is open;

wherein for each individual compartment selected from the plurality of compartments, the span of the selected individual compartment in the length direction is independent from any other measured span in the length direction of any individual compartment remaining in the plurality of compartments;

wherein for each individual compartment selected from the plurality of compartments, the span of the selected individual compartment in the width direction is independent from any other measured span in the width direction of any individual compartment remaining in the plurality of compartments;

wherein for each individual compartment selected from the plurality of compartments, the span of the selected individual compartment in the height direction is independent from any other measured span in the height direction of any individual compartment remaining in the plurality of compartments;

wherein the integrated drain comprises a plurality of drain slots, a drain port, and a drain channel;

wherein the plurality of drain slots are formed in the incline portion of the base;

wherein the incline portion of the base is a modification to portions of the base underneath selected individual compartments;

wherein in the portions of the base with the incline portion, the specific modification is a gradient that is formed in the base that causes the surface of the base to deviate from a horizontal orientation such that liquids that accumulate on these portions of the base will flow in a controlled direction;

wherein each of the plurality of drain slots is a channel formed in the incline portion of the base.

2. The domestic article according to claim 1 wherein each of the plurality of drain slots are formed within the base such that each of the plurality of drain slots will route accumulated water to the drain port.

3. The domestic article according to claim 2 the drain port is an aperture formed through in the face of an individual chamber such that accumulated liquids flow from the plurality of drain slots through the drain port.

4. The domestic article according to claim 3 wherein the drain channel is a gutter;

wherein the drain channel is formed on the exterior opening of the drain port.

5. The domestic article according to claim 4 wherein the plurality of compartments further comprises a soap compartment, a toothbrush compartment, a toothpaste compartment and a razor compartment.

6. The domestic article according to claim 5 wherein the soap compartment is positioned on an incline portion of the base;

wherein the drain port and the drain channel are formed in a face of the soap compartment.

7. The domestic article according to claim 6 wherein the toothbrush compartment is positioned on an incline portion of the base.

8. The domestic article according to claim 7 wherein the toothbrush compartment is removably attached to the base.

9. The domestic article according to claim 8 wherein the toothbrush compartment comprises six or more chambers.

* * * * *